US006966449B2

(12) United States Patent
Williams

(10) Patent No.: US 6,966,449 B2
(45) Date of Patent: Nov. 22, 2005

(54) BULK BOX

(75) Inventor: Richard Alan Williams, Cuyahoga Falls, OH (US)

(73) Assignee: The Little Tikes Company, Hudson, OH (US)

( * ) Notice: Subject to any disclaimer, the term of this patent is extended or adjusted under 35 U.S.C. 154(b) by 106 days.

(21) Appl. No.: 10/335,709

(22) Filed: Jan. 2, 2003

(65) Prior Publication Data

US 2004/0129699 A1 Jul. 8, 2004

(51) Int. Cl.[7] ..... B65D 6/16

(52) U.S. Cl. ..... 220/4.31; 206/509; 206/600; 220/4.32

(58) Field of Search ..... 220/1.5, 4.28, 220/4.31, 4.32, 6, 7, 4.33; 206/600, 509

(56) References Cited

U.S. PATENT DOCUMENTS

| | | | | | |
|---|---|---|---|---|---|
| 2,822,106 | A | * | 2/1958 | Fabian et al. | 220/4.28 |
| 3,410,441 | A | * | 11/1968 | Rhyne | 220/4.28 |
| 3,982,650 | A | * | 9/1976 | Ichihara | 220/4.28 |
| 4,000,827 | A | * | 1/1977 | Emery | 220/4.28 |
| 4,466,541 | A | | 8/1984 | Tabler et al. | |
| D277,042 | S | * | 1/1985 | Carter et al. | D3/305 |
| 4,572,368 | A | | 2/1986 | Miller et al. | |
| 4,591,065 | A | * | 5/1986 | Foy | 220/7 |
| 4,620,644 | A | | 11/1986 | Miller | |
| 4,735,331 | A | * | 4/1988 | Keenan et al. | 220/6 |
| 4,809,851 | A | * | 3/1989 | Oestreich et al. | 206/599 |
| RE32,966 | E | | 6/1989 | Miller et al. | |
| D304,120 | S | | 10/1989 | Buchanan et al. | |
| 4,890,740 | A | | 1/1990 | Tabler | |
| 4,936,458 | A | | 6/1990 | Tabler et al. | |
| 4,960,207 | A | | 10/1990 | Tabler et al. | |
| 4,974,737 | A | | 12/1990 | Miller | |
| 5,094,356 | A | | 3/1992 | Miller | |
| 5,673,791 | A | | 10/1997 | Jamison | |
| 5,722,550 | A | | 3/1998 | Ficker | |
| 5,816,425 | A | * | 10/1998 | Keip et al. | 220/4.31 |
| 5,845,799 | A | | 12/1998 | Deaton | |
| 6,189,695 | B1 | * | 2/2001 | Ching-rong | 206/509 |
| 6,209,741 | B1 | * | 4/2001 | Boucher-Giles | 220/6 |
| 6,253,948 | B1 | | 7/2001 | Ficker | |
| 6,446,825 | B1 | * | 9/2002 | Godoy | 220/6 |

* cited by examiner

*Primary Examiner*—Joseph C. Merek
(74) *Attorney, Agent, or Firm*—Renner, Otto, Boisselle & Sklar, LLP

(57) ABSTRACT

A bulk box (200) comprising a base panel (202) and four side panels (204, 206) individually formed and assembled into a container. The bottom surface (232) of the base panel (202) comprises a matrix of pedestals (236) with the ground-contacting face (244) of each of the corner pedestals extending to the cornermost portions of the respective pedestal. The side panels (204, 206) include lateral flanges (254, 274) which overlap to form "double-thickness" corners. The side panels (204, 206) also have upwardly extending tabs (266, 286) and the base panel (202) has notches (242) so that, when a plurality of the bulk boxes are stacked one on top of the other, the tabs of a lower bulk box are received within the notches of an upper bulk box.

33 Claims, 11 Drawing Sheets

BULK BOX

FIELD OF THE INVENTION

The present invention relates generally as indicated to a bulk box and, more particularly, to a stackable bulk box comprising a base panel and four side panels which are individually formed and then assembled together to form a container.

BACKGROUND OF THE INVENTION

A bulk box commonly comprises a base panel and four side panels assembled together to form a container. The panels usually are made of plastic material and individually formed in a molding process. Mating members (e.g., slots and hooks) usually are provided on the panels so that they may be assembled together easily without the use of tools or other equipment.

Bulk boxes typically are filled with goods at a warehouse location and then transported to a distribution location. At the distribution location, the goods are unpacked from the bulk boxes and placed in hoppers, shelf boxes, or similar containers arranged in a flow racking system. The bulk boxes usually are then returned to the warehouse location either empty or perhaps filled with goods from the distribution location. If the bulk boxes are empty and space minimization is desirable, the bulk boxes will be disassembled for the return trip.

The transportation of the bulk boxes between the warehouse location and the distribution location often is accomplished with a truck, whereby space-optimization within the truck's trailer may be important. Also, or in any event, the bulk boxes should be capable of being loaded or unloaded with standard equipment (i.e., a forklift) and thus must be compatible therewith. Furthermore, at the warehouse location, within the transporting trucks, and/or at the distribution location, footprint concerns are often quite significant, whereby the ability to safely stack a plurality of bulk boxes can be essential.

Accordingly, a bulk box design preferably includes a construction that can be initially assembled without tools, is forklift-tine compatible, is sized to optimize truck trailer space, allows a plurality of boxes to be safely stacked, and/or can be assembled and disassembled selectively. Moreover, when bulk boxes are used to ship relatively heavy goods, the panels must have sufficient structural strengths to withstand the strain of the combined weight of the goods. This commonly is accomplished by causing the panels to incorporate structural members (e.g., metal bars or wooden rods) to increase stiffness. Additionally or alternatively, the construction of the bulk box and/or the panels must be such that stacking stability is not sacrificed even with heavy loads and/or at high stacking heights.

SUMMARY OF THE INVENTION

The present invention provides a bulk box that initially can be assembled without tools, is forklift-tine compatible, can be sized to optimize truck trailer space, allows a plurality of boxes to be safely stacked, and/or can be assembled and disassembled selectively. Moreover, the bulk box of the present invention can carry relatively heavy goods even if the panels have an all-plastic construction without added structural members. Additionally or alternatively, the construction of the bulk box and/or the panels can be such that it does not sacrifice stacking stability and, in fact, can improve stability while also providing a visible verification of box-to-box interlocking.

More particularly, the present invention provides a bulk box comprising a base panel and four side panels individually formed and assembled into a container. The four side panels can be joined together with slots and hooks, and at least some of the side panels can be joined to the base panel with slots and hooks. The four side panels can include a first panel and a second panel, arranged substantially parallel to each other, and a third panel and a fourth panel, arranged substantially parallel to each other and substantially perpendicular to the first and second panels.

According to one aspect of the invention, the side panels are positioned to provide four corners and at least some of the side panels include lateral flanges which overlap with a portion of the other side panel forming the corner. Specifically, each of the four panels can include a lateral flange on each lateral edge of the respective panel, and each of the lateral flanges can overlap a lateral flange of another panel. More specifically, the lateral flanges of the first and second panels each can comprise a first leg extending parallel to the main body of the respective panel and a second leg extending perpendicularly inward from the first leg and beyond the respective panel's box-interior surface. The lateral flanges of the third and fourth panels each can comprise a first leg extending perpendicularly inward and beyond the respective panel's box-interior surface and a second leg extending perpendicularly outward from the first leg. This corner construction of the bulk box provides a "double-thickness" union and, even if the bulk box is expected to carry relatively heavy goods, the all-plastic panels can be made sufficiently strong without the incorporation of structural members. Also, when a plurality of the bulk boxes are stacked, the corner weight of the stacked boxes is carried by the "double-thickness" unions between the side panels.

According to another aspect of the invention, the base panel comprises a matrix of pedestals which can include four corner pedestals and/or-can be an at least three-by-three matrix. The pedestals can define two recessed rows sized and positioned to accommodate forklift tines, whereby the bulk box is fork-lift compatible. In any event, the ground-contacting face of each of the corner pedestals extends to the cornermost portions of the respective corner pedestal. The increased surface area of the corner pedestals (as compared to conventional corner pedestals having their cornermost portions grooved) provides a more stable rest for the bulk box, and especially for a plurality of bulk boxes stacked together.

According to a further aspect of the invention, at least some of the side panels have tabs extending upward from their top edge, and the base panel has notches aligned with the tabs and sized to receive the tabs. When a plurality of the bulk boxes are stacked one on top of the other, the tabs of a lower bulk box are received within the notches of an upper bulk box. This provides a positive mechanical interlock between vertically adjacent boxes, thereby enhancing stacking stability. Further, the receipt of the tabs within the notches can be seen from the outside of the boxes, thereby providing visual verification of proper interlocking between the boxes.

These and other features of the invention are fully described and particularly pointed out in the claims. The following description and annexed drawings set forth in detail a certain illustrative embodiment of the invention, this embodiment being indicative of but one of the various ways in which the principles of the invention may be employed.

DRAWINGS

FIG. 1A is a perspective view of a prior art bulk box 100, the bulk box 100 comprising a base panel 102, two slotted side panels 104, and two hooked side panels 106.

FIG. 1B is a perspective view of the bulk box 100 with a slotted side panel 104 removed and a hooked side panel 106 removed.

Figure 3A:
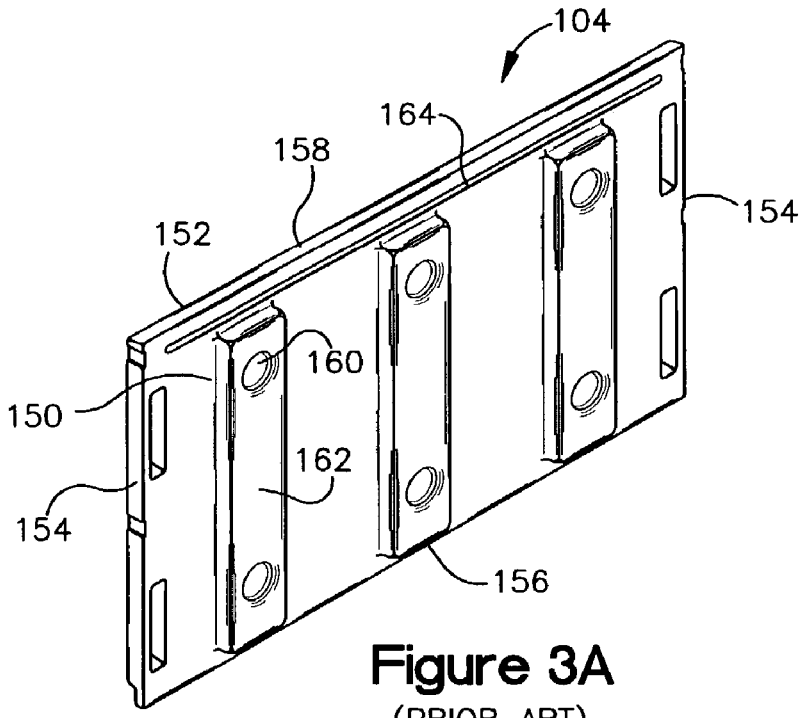
Figure 3A (PRIOR ART)

FIG. 3A is a perspective view of a slotted side panel 104 disassembled from the rest of the bulk box 100, the visible surface of the side panel 104 corresponding to the inside of the bulk box.

Figure 3B:
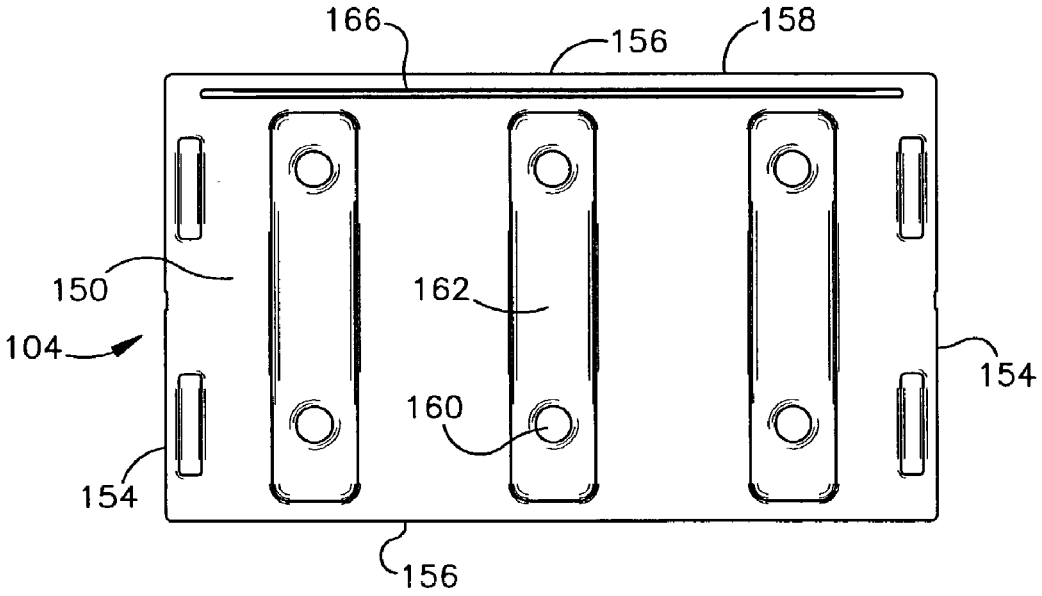
Figure 3B (PRIOR ART)

FIG. 3B is a plan view of the slotted side panel 104 disassembled from the rest of the bulk box 100, the visible surface of the side panel 104 corresponding to the inside of the bulk box.

Figure 4A:
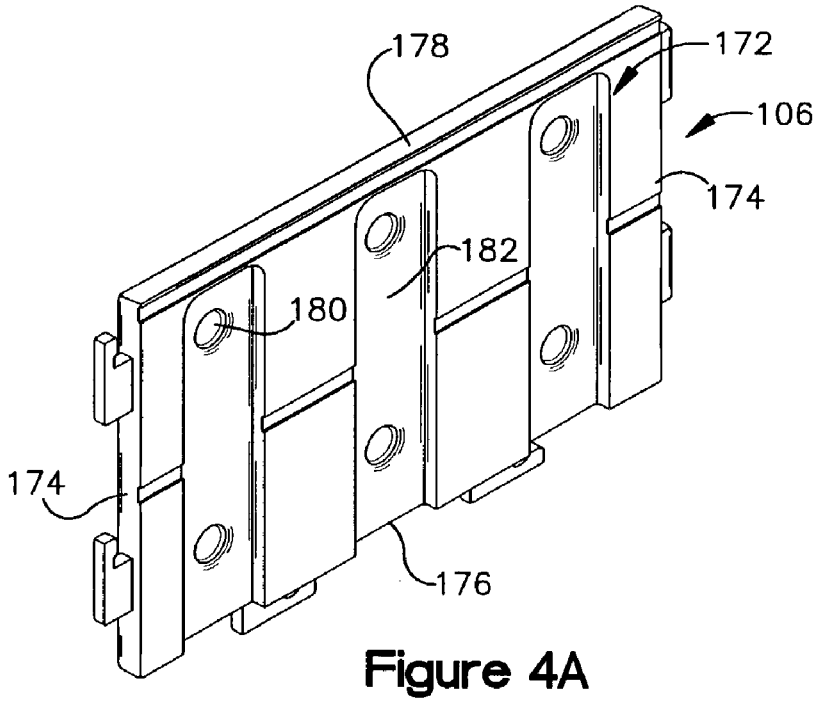
Figure 4A (PRIOR ART)

FIG. 4A is a perspective view of a hooked side panel 106 disassembled from the rest of the bulk box 100, the visible surface of the side panel 106 corresponding to the inside of the bulk box.

Figure 4B:
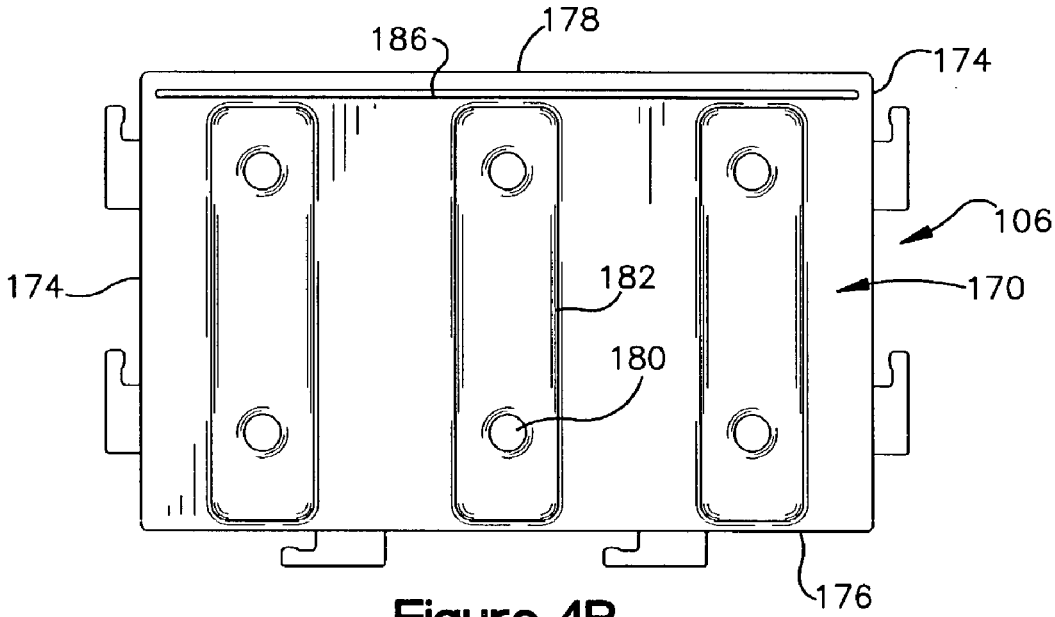
Figure 4B (PRIOR ART)

FIG. 4B is a plan view of the hooked side panel 106 disassembled from the rest of the bulk box 100, the visible surface of the side panel 106 corresponding to the outside of the bulk box.

Figure 1A:
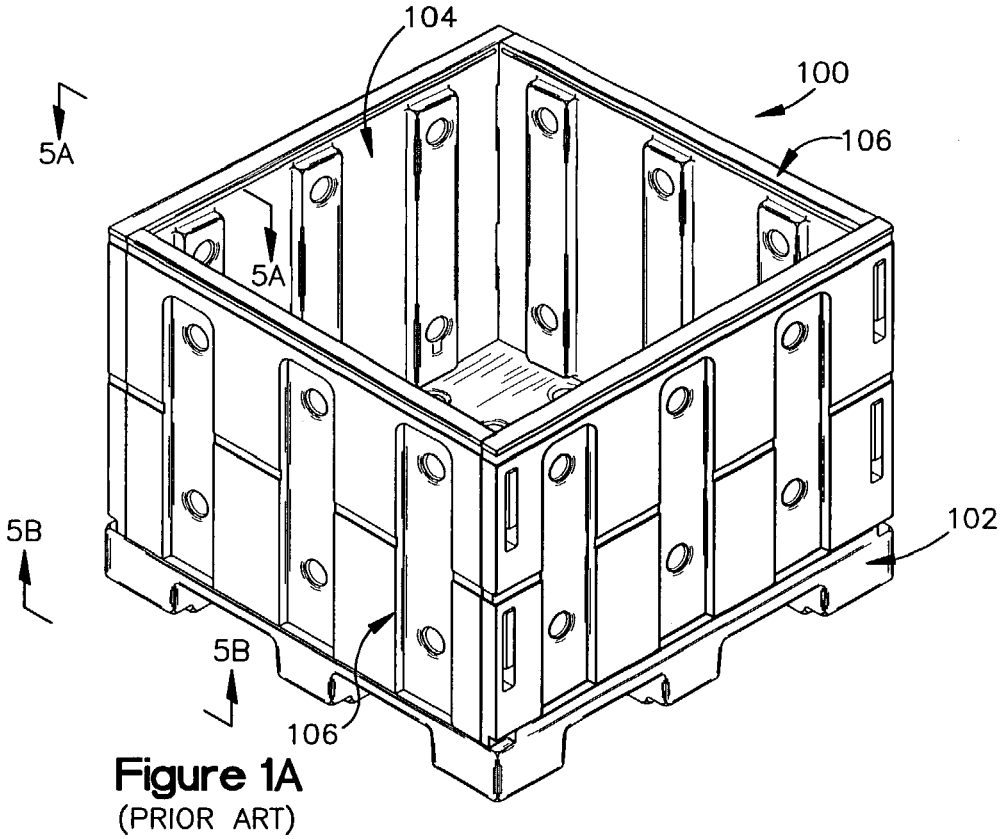
Figure 1A (PRIOR ART)
FIG. 1C is a cross-section taken along line 1C—1C in FIG. 1A.
Figure 5A:
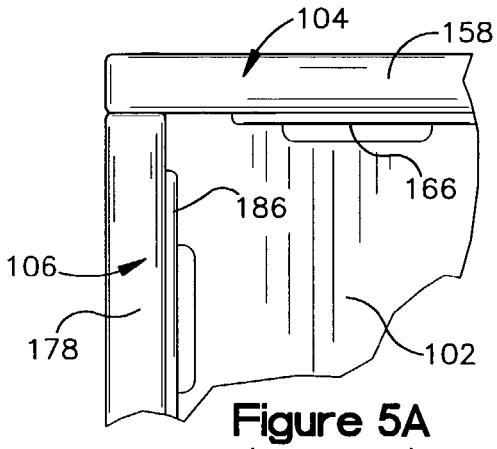
Figure 5A (PRIOR ART)

FIG. 5A is a top view of a corner portion of the bulk box 100 as seen from line 5A—5A in FIG. 1A.

Figure 5B:
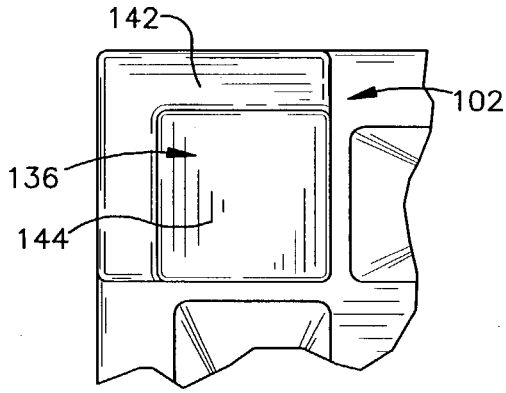
Figure 5B (PRIOR ART)

FIG. 5B is a bottom view of a corner portion of the bulk box 100 as seen from line 5B—5B in FIG. 1A.

Figure 6A:
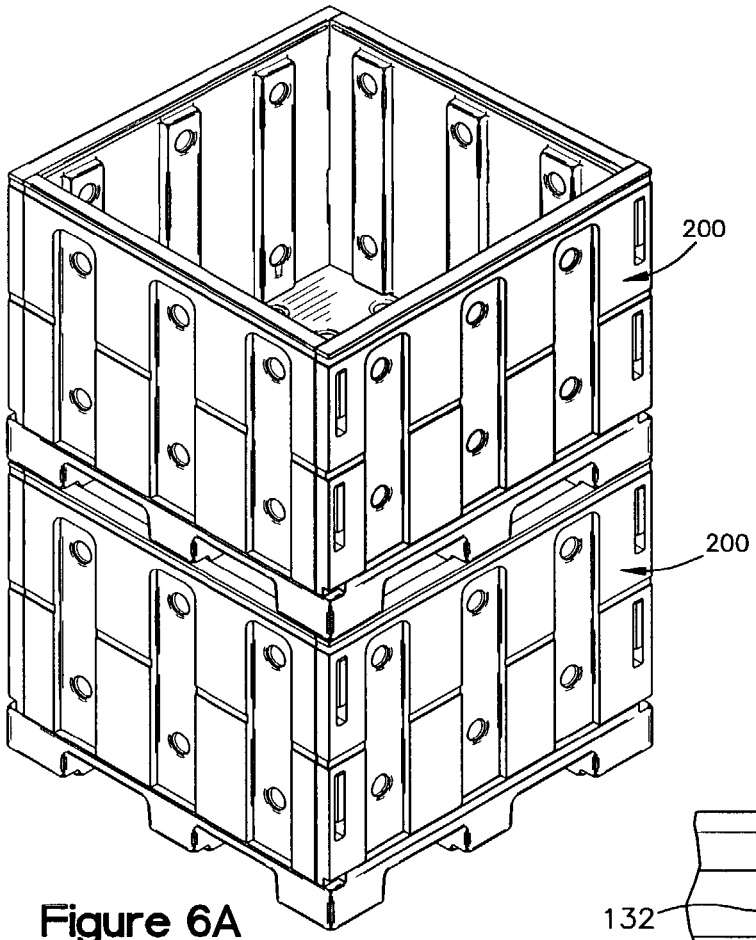
Figure 6A (PRIOR ART)

FIG. 6A is a perspective view of a stacked plurality of the prior art bulk boxes 100.

Figure 6B:
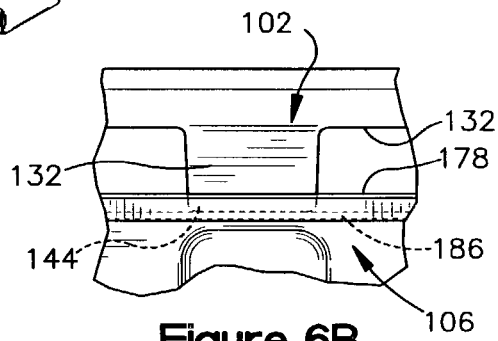
Figure 6B (PRIOR ART)

FIG. 6B is a close-up view of the seam between adjacent stacked bulk boxes 100 in FIG. 6A.

Figure 7A:
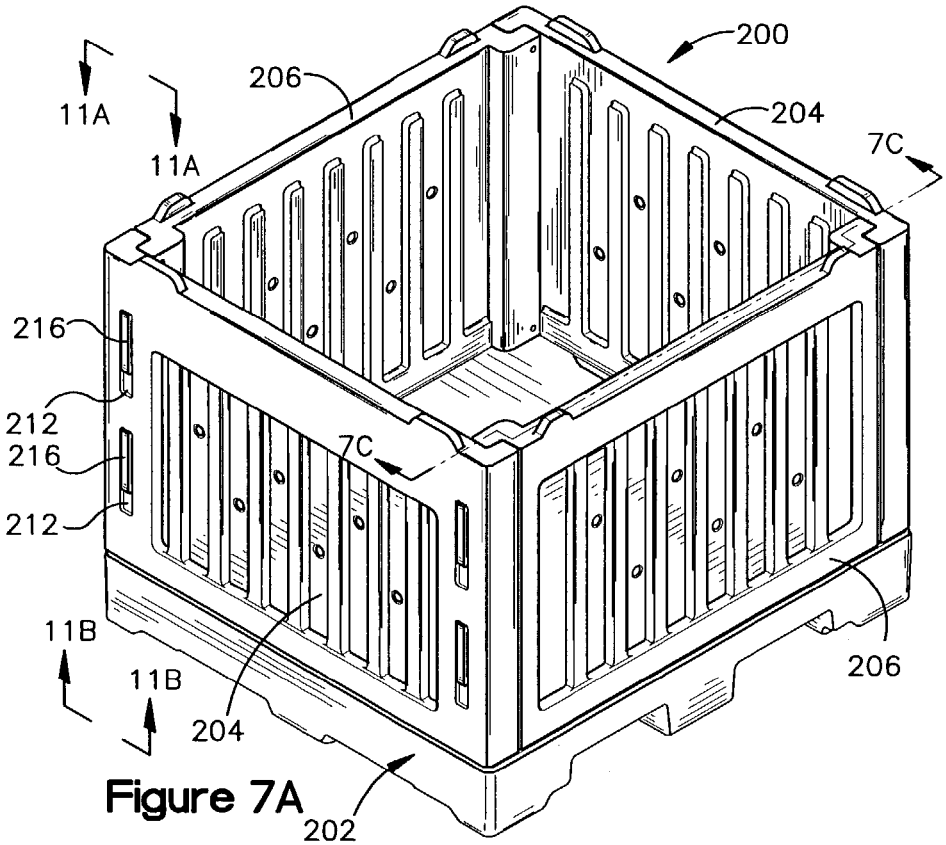

FIG. 7A is a perspective view of a bulk box 200 according to the present invention, the bulk box 200 comprising a base panel 202, two slotted side panels 204, and two hooked side panels 206.

Figure 7B:
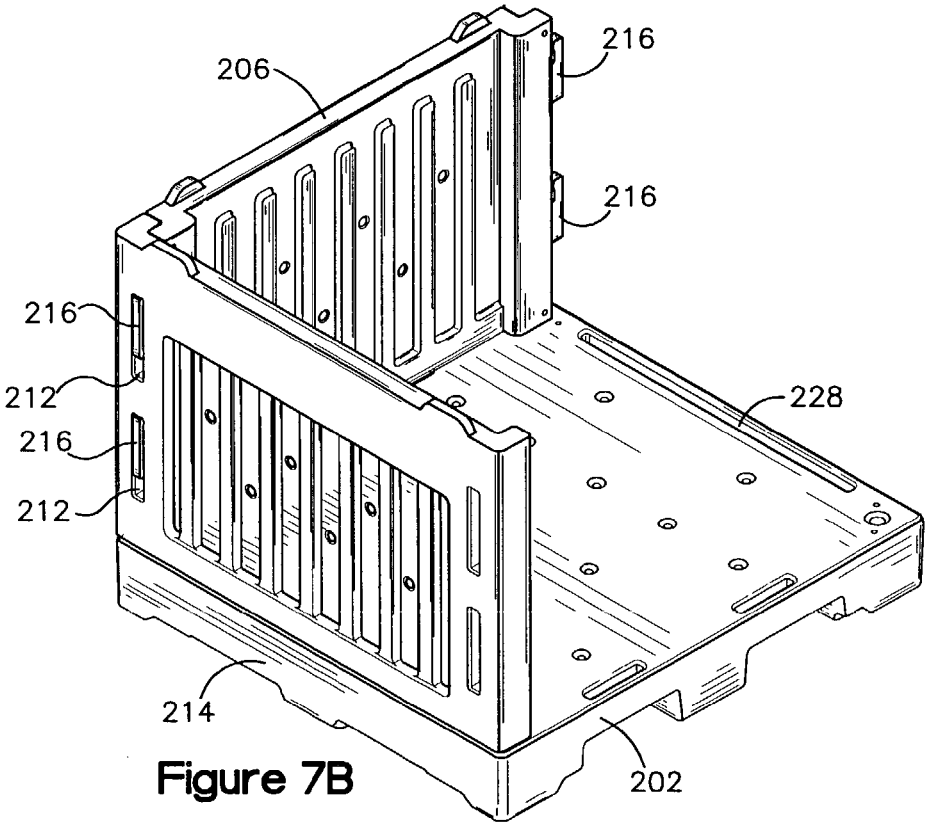

FIG. 7B is a perspective view of the bulk box 200 with a slotted side panel 204 removed and a hooked side panel 206 removed.

Figure 7C:
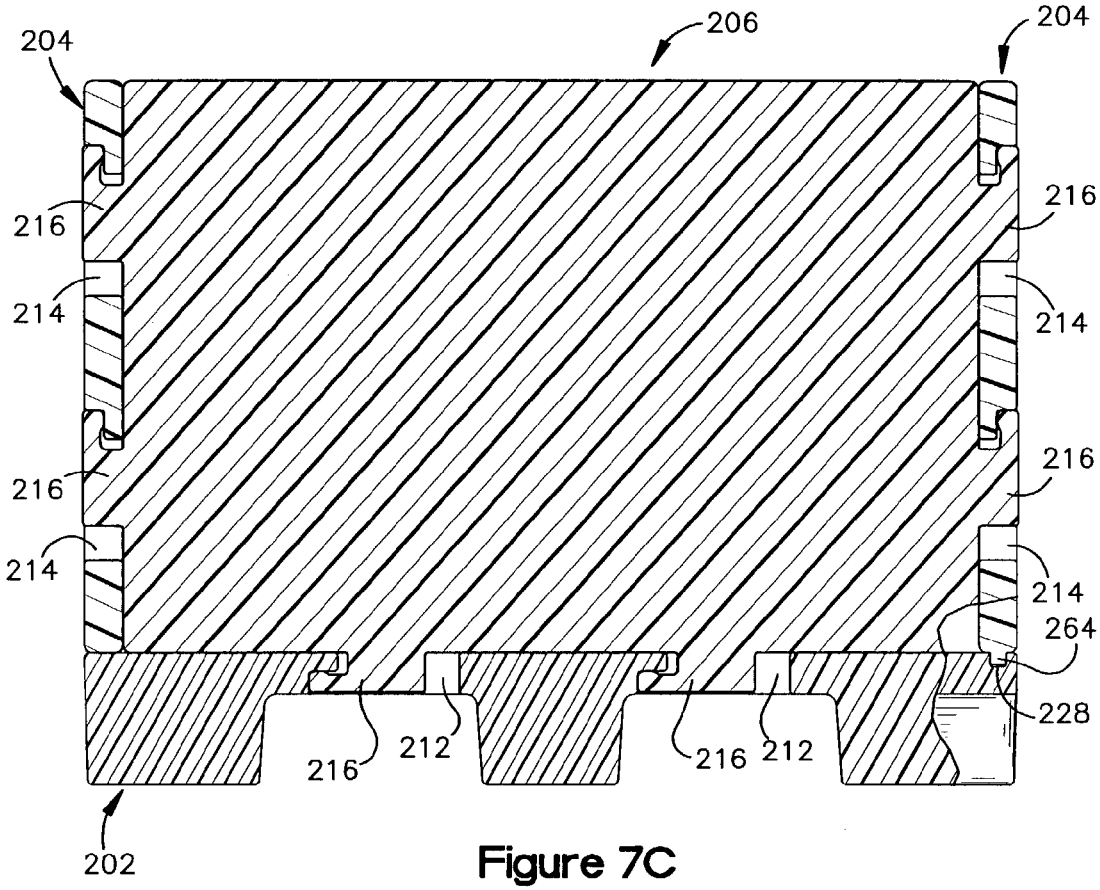

FIG. 7C is a cross-section taken along line 1C—1C in FIG. 1A.

Figure 8A:
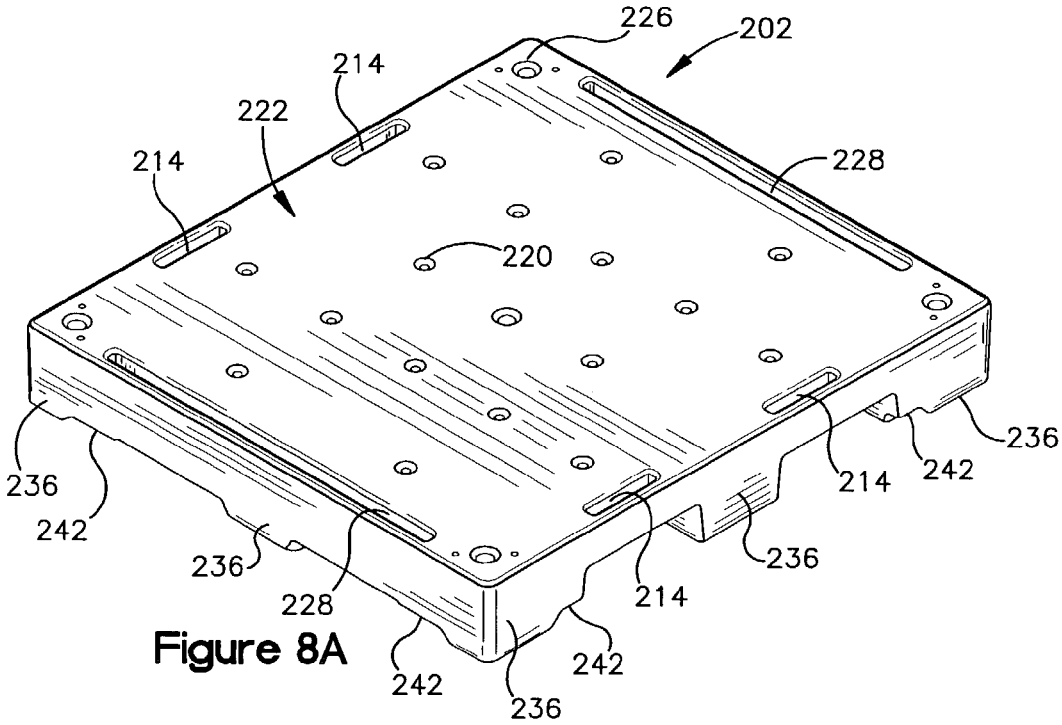

FIG. 8A is a top perspective view of the base panel 202 disassembled from the rest of the bulk box 200.

Figure 8B:
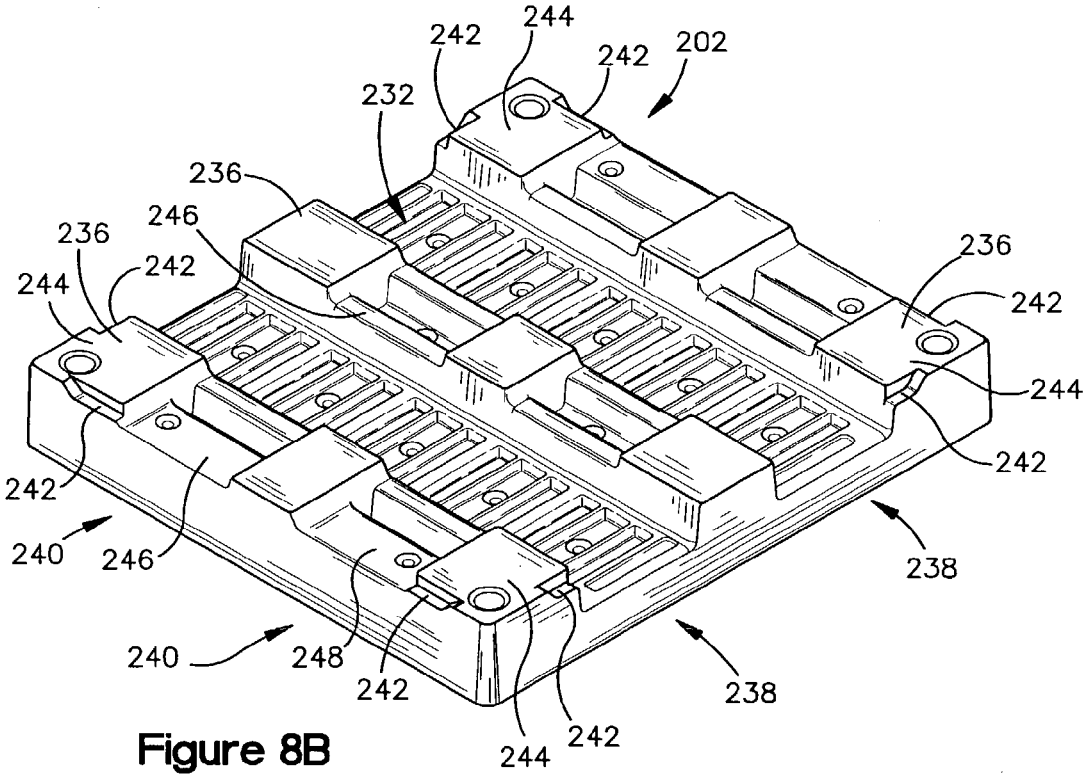

FIG. 8B is a bottom perspective view of the base panel 202 disassembled from the rest of the bulk box 200.

Figure 9A:
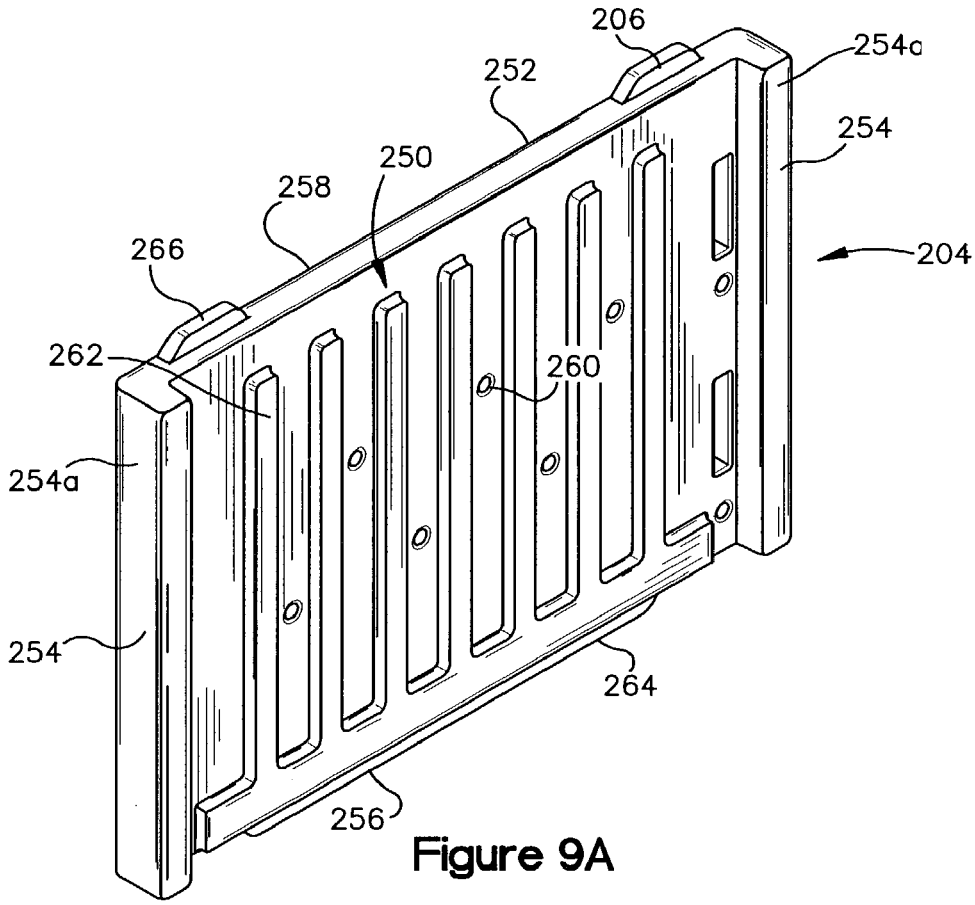

FIG. 9A is a perspective view of a slotted side panel 204 disassembled from the rest of the bulk box 200, the visible surface of the side panel 204 corresponding to the inside of the bulk box 200.

Figure 9B:
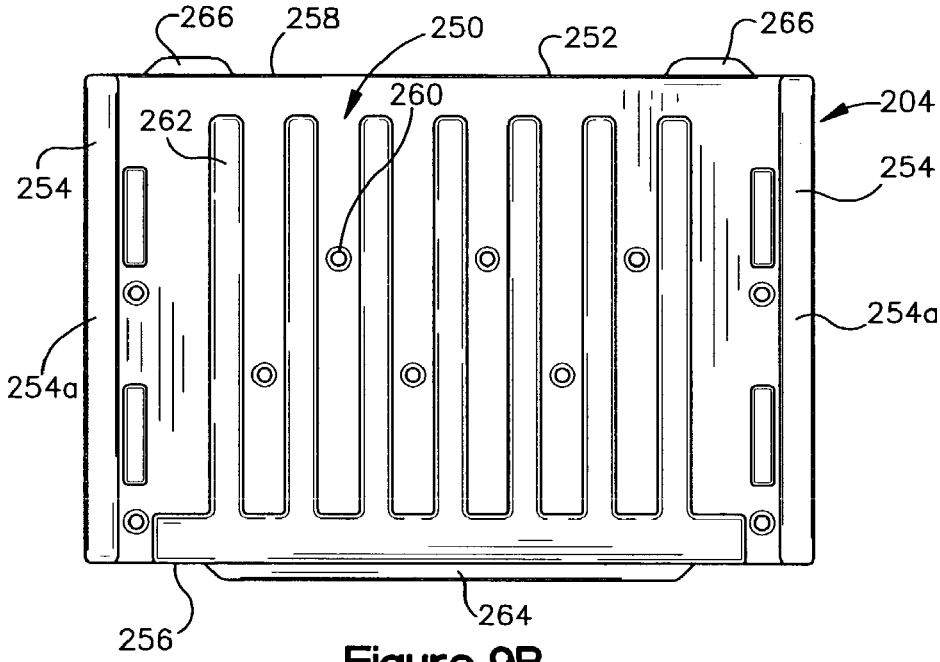

FIG. 9B is a plan view of the slotted side panel 204 disassembled from the rest of the bulk box 200, the visible surface of the side panel 204 corresponding to the inside of the bulk box 200.

Figure 10A:
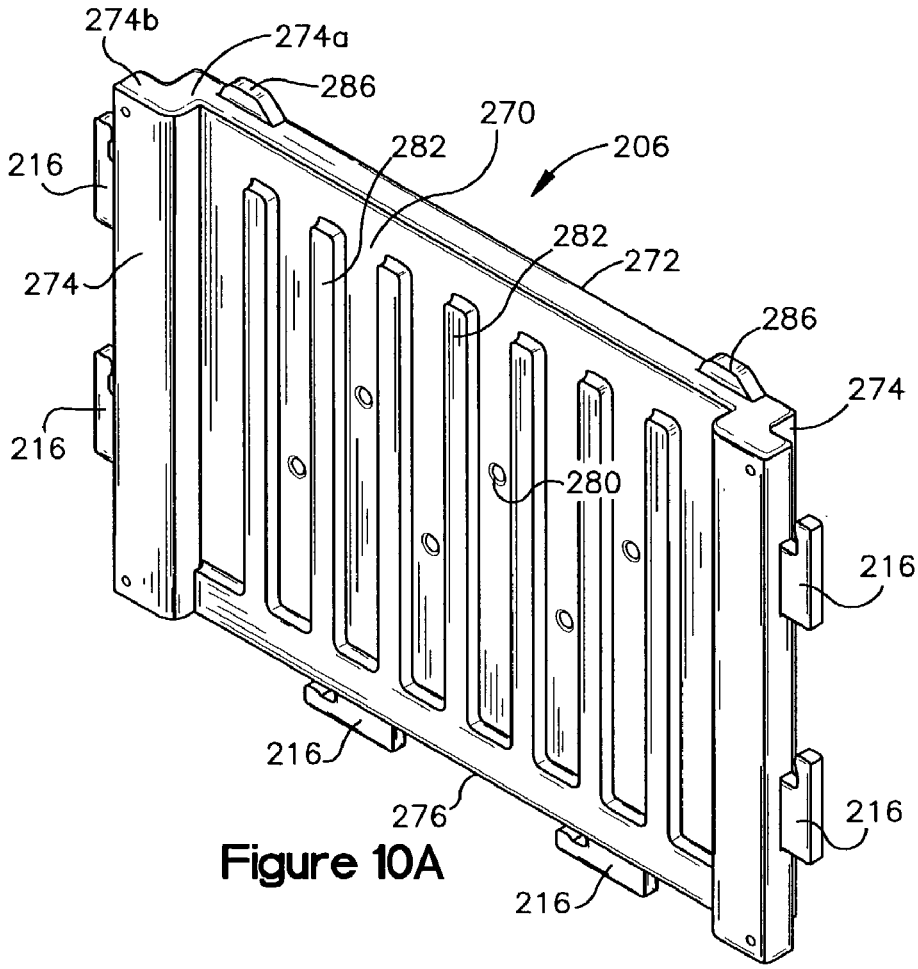

FIG. 10A is a perspective view of a hooked side panel 206 disassembled from the rest of the bulk box 200, the visible surface of the side panel 206 corresponding to the inside of the bulk box 200.

Figure 10B:
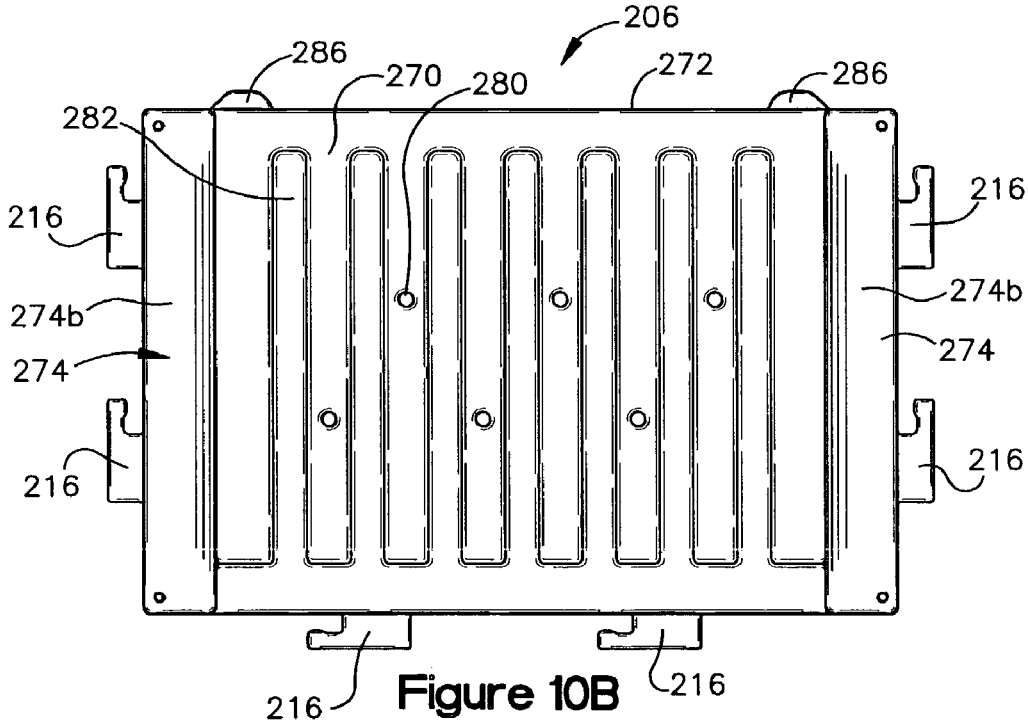

FIG. 10B is a perspective view of a hooked side panel 206 disassembled from the rest of the bulk box 200, the visible surface of the side panel 206 corresponding to the inside of the bulk box 200.

Figure 11A:
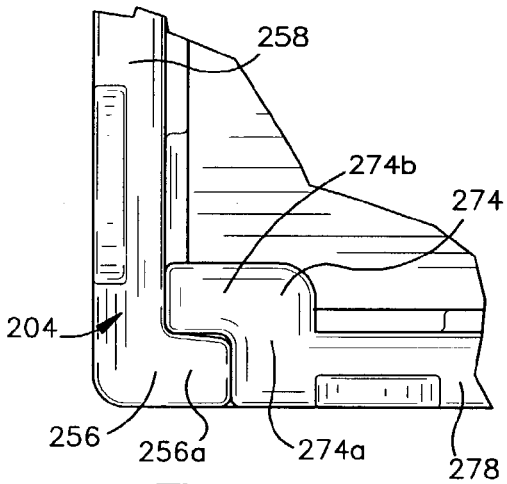

FIG. 11A is a top view of a corner portion of the bulk box 200 as seen from line 11A—11A in FIG. 7A.

Figure 11B:
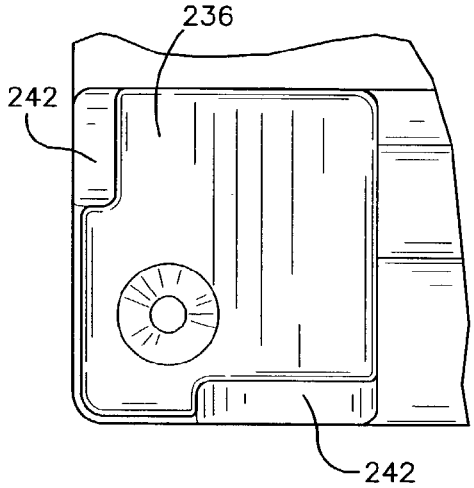

FIG. 11B is a bottom view of a corner portion of the bulk box 200 as seen from line 11B—11B in FIG. 7A.

Figure 12A:
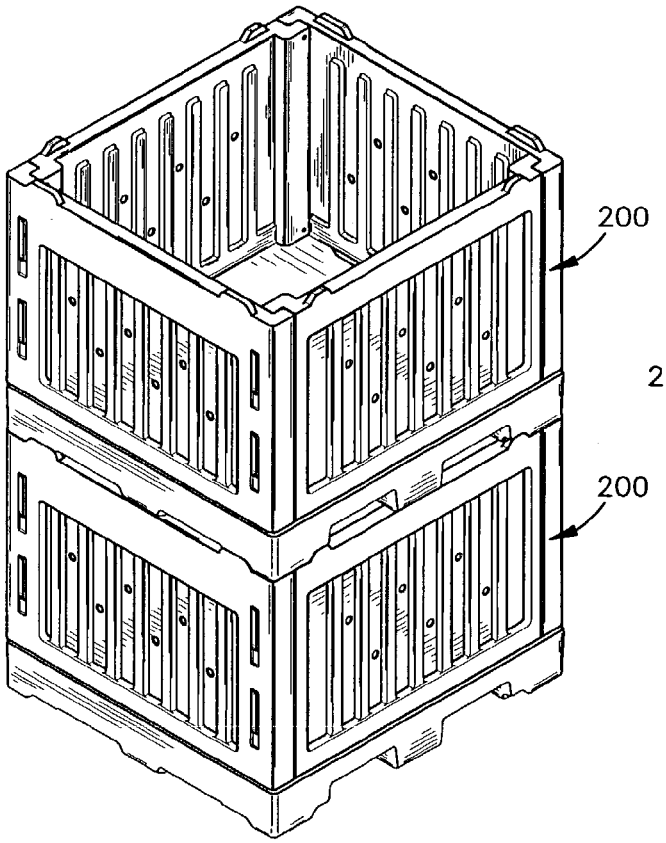

FIG. 12A is a perspective view of a stacked plurality of the bulk boxes 200.

Figure 12B:
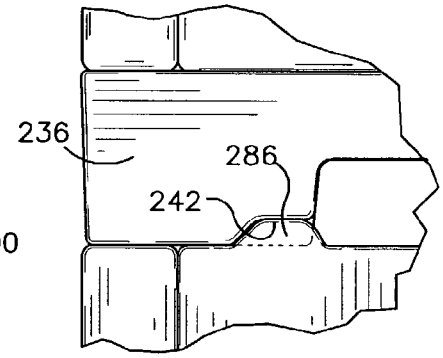

FIG. 12B is a close-up view of the interlocking between the adjacent stacked bulk boxes 200 shown in FIG. 12A.

DETAILED DESCRIPTION

Figure 1B:
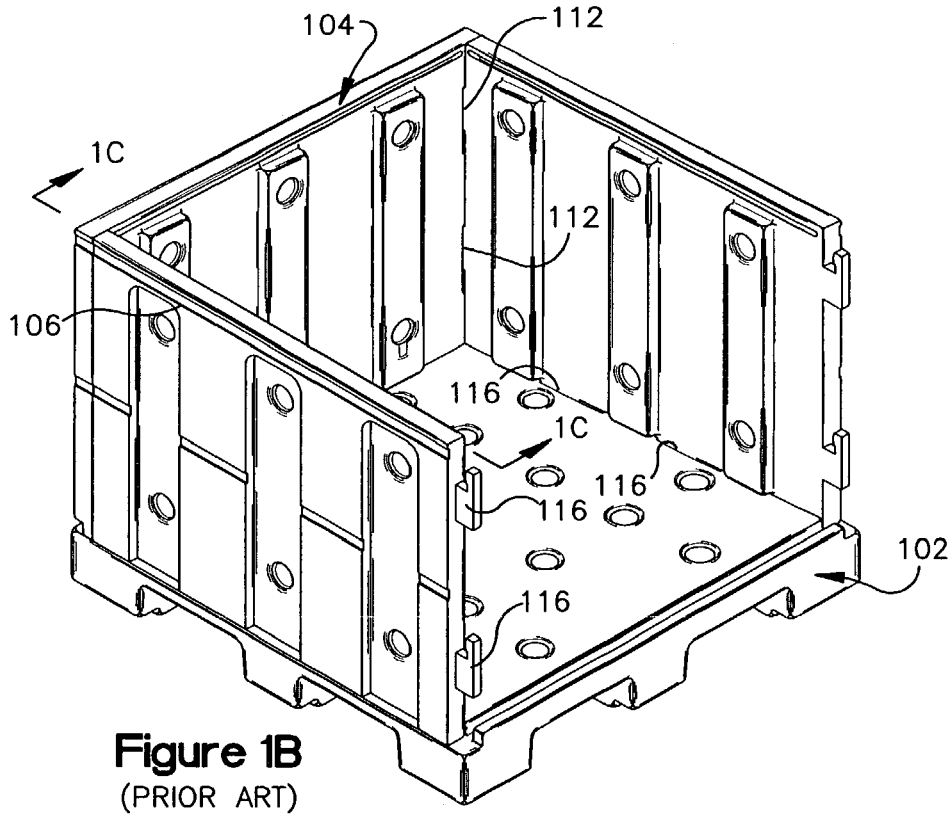
Figure 1B (PRIOR ART)
Figure 1C:
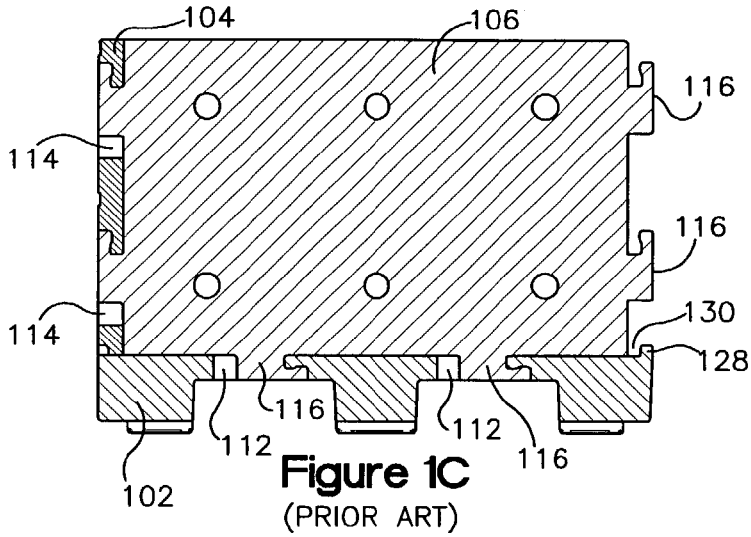
Figure 1C (PRIOR ART)

Referring now to the drawings in detail, and initially to FIGS. 1A, 1B and 1C, a prior art bulk box 100 is shown. The bulk box 100 comprises a base panel 102, two side panels 104, and two side panels 106 which are formed individually and then assembled together. The panels can be made from a plastic or resin material and formed in an appropriate molding process (e.g., rotational molding, blow molding, injection molding, structural foam molding) or other suitable process (e.g., twin-sheet thermoforming). If the bulk box 100 is expected to carry relatively heavy goods, structural members (e.g., metal bars or wooden rods) are incorporated into the panels 102, 104 and/or 106.

The panels 102, 104, and 106 are assembled together using a slot-and-hook mating arrangement. Specifically, the base panel 102 and the side panels 104 have slots 112 and 114, respectively, which mate with corresponding hooks 116 in the side panels 106. The slots 112 in the base panel 102 and the slots 114 in the side panels 104 each have a rectangular receiving portion which opens into a wider rectangular capturing portion, whereby each slot has a fat-stem-L shape. The hooks 116 have a similar geometry, whereby they may be mated with the slots 112/114 when the panels are assembled.

To assemble the bulk box 100, a hooked panel 106 is positioned so that its bottom hooks 116 are vertically aligned with the receiving portion of the slots 112 in the base panel 102 and then the panel 106 is lowered thereinto. The panel 106 is then slid in the appropriate direction (to the right in FIG. 1C) so that the thin legs of the L-shaped hooks 116 are captured within the rectangular capturing portion of the slots 112. This process is repeated with the other panel 106 so that opposite sides of the bulk box 100 are assembled to the base panel 102. A slotted panel 104 is then positioned so that the receiving portion of its slots 114 are horizontally aligned with the lateral hooks 116 of the two already-assembled panels 106. The panel 104 is then slid towards the lateral hooks 116 for insertion of the hooks into the slots 114. The panel 104 is then lowered so that the thin legs of the L-shaped hooks 116 are captured within the capturing portion of the slots 114. This process is repeated with the other panel 104 to complete the assembly of the bulk box 100.

Figure 2A:
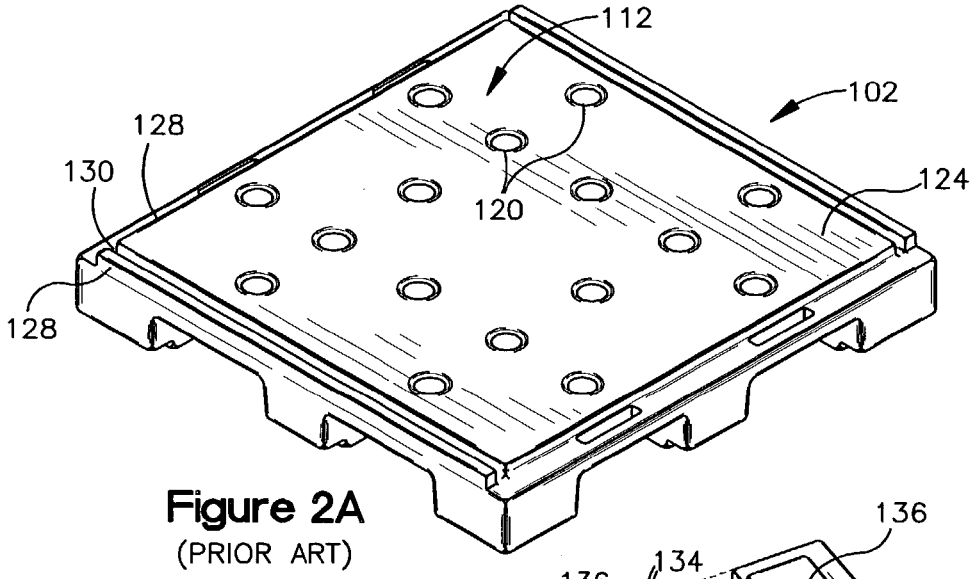
Figure 2A (PRIOR ART)
FIG. 2A is a top perspective view of the base panel 102 disassembled from the rest of the bulk box 100.
Figure 2B:
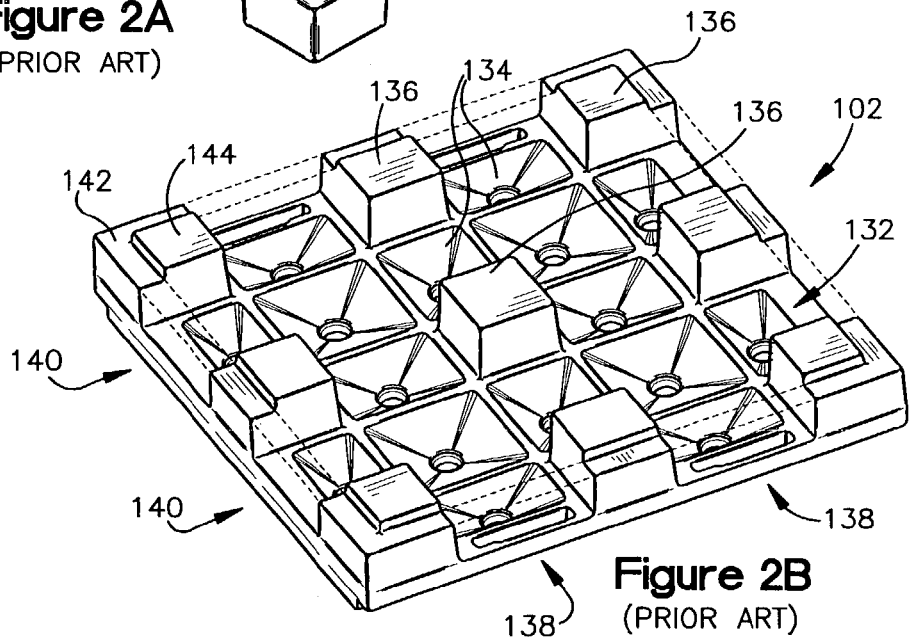
Figure 2B (PRIOR ART)
FIG. 2B is a bottom perspective view of the base panel 102 disassembled from the rest of the bulk box 100.

Referring now to FIGS. 2A and 2B, the base panel 102 is shown disassembled from the rest of the bulk box 100. The base panel 102 has an overall square shape (in plan) and has through-holes 120 arranged to accommodate molding procedures. As is best shown in FIG. 2A, the top surface 122 of the base panel 102 includes a raised square stage 124 centrally positioned and surrounded by a perimeter rim 126. A ledge 128 is positioned adjacent to each of the two opposite margins of the rim 126 (corresponding to the location of the slotted side panels 104) to thereby define a groove 130 between each ledge 128 and the closest edge of the platform 124. The slots 112 are formed within the rim 126 on the remaining two opposite sides (corresponding to the location of the hooked side panels 106).

As best shown in FIG. 2B, the bottom surface 132 of the base panel 102 has dimpled areas 134 corresponding to the through-holes 120 and a three-by-three matrix of pedestals 136 separated by the dimpled areas 134. The pedestals 136 divide the bottom surface 132 into two recessed rows 138 and two recessed columns 140. The rows 138 and columns 140 are sized and positioned to receive forklift tines, whereby the box 100 accommodates forklift approach from all four lateral directions.

Each pedestal 136 has a shortened-cube shape with the cube's bottom face (the upper face in the upside-down orientation shown in FIG. 2B) being positioned parallel with the main plane of the panel 102. The bottom face of each of the eight perimeter pedestals 136 is grooved to collectively form a square stacking frame 142 with the ungrooved portions forming ground-contacting platforms 144. Thus, the four corner pedestals 136 (which have two frame-forming faces) each include a square-L-shaped groove and the remaining corner ground-contacting platform 144 has a smaller surface area than the non-corner pedestals. Also, with the four corner pedestals 136, the ground-contacting platform 144 does not extend into the pedestal's cornermost region.

Referring now to FIGS. 3A and 3B, one of the slotted panels 104 is shown disassembled from the rest of the bulk box 100. The panel 104 has a generally rectangular shape with a width corresponding to the width of the base panel 102 and a height corresponding to the desired height of the bulk box 100. More specifically, the panel 104 has a box-interior surface 150, a box-exterior surface 152, lateral edges 154, a bottom edge 156, and a top edge 158. With particular reference to the top edge 158, it has an elongated rectangular shape.

The panel 104 includes through-holes 160 and raised ribs 162 arranged for mold-accommodating purposes and/or strength-enhancement on the surfaces 150 and 152. A pair of the slots 114 extend from each of the lateral edges 154 for receipt of the hooks 116 in the other side panels 106. Another pair of the slots 114 extend from the panel's bottom edge 156 for receipt of the hooks 116 in the base panel 102. A shoulder 164 is provided on the box-exterior surface 152, adjacent the bottom edge 156, for mating with the groove 130 in the base panel 102. A ridge 166 is provided on the box-interior surface 150, adjacent the top edge 158.

Referring now to FIGS. 4A and 4B, one of the hooked panels 106 is shown disassembled from the rest of the bulk box 100. The panel 106 also has a generally rectangular shape with a width corresponding to the width of the base panel 102 and a height corresponding to the desired height of the bulk box 100. More specifically, the panel 106 has a box-interior surface 170, a box-exterior surface 172, lateral edges 174, a bottom edge 176, and a top edge 178. With particular reference to the top edge 178, it has an elongated rectangular shape.

The panel 106 also includes through-holes 180 and raised ribs 182 arranged for mold-accommodating purposes and/or strength-enhancement on the surfaces 170 and 172. One pair of the hooks 116 extend from the bottom edge 176 of the panel 106 and one pair of hooks 116 extend from the lateral edges 174 of the panel 106. A ridge 186 is provided on the box-interior surface 170, adjacent the top edge 178. The ridge 186, in combination with the ridges 166 in the panels 104, form a rectangular shoulder (with disjointed corners) around the upper interior perimeter of the bulk box 100.

Accordingly, as is best seen in FIG. 5A, a top corner portion of the bulk box 100 comprises a lateral-most section of the box-interior surface 150 of a slotted side panel 104 abutted against the lateral edge 174 of the adjacent hooked side panel 106. Additionally, as is best seen in FIG. 5B, a bottom corner portion of the bulk box 100 comprises a corner pedestal 136 with a corner section of the stacking frame 142 and the smaller ground-contacting platform 144. It may be again noted that the platform 144 does not extend into the cornermost region of the pedestal 136.

Referring now to FIG. 6A, a plurality of the bulk boxes 100 are shown stacked one on top of the other. In this stacked arrangement, the upper edges of the lower bulk box (i.e., the top edges 158 of the slotted panel 104 and the top edges 178 of the hooked panel 106) are received within the stacking frame 142 of the bottom panel 102 of the upper bulk box. Thus, the corner weight of the stacked boxes 100 is carried by the abutting unions between the side panels 104 and 106 and ultimately rests upon the corner pedestals 136 (and specifically the small-surface-area platforms 144) of the lowermost bulk box 100. Also, as is best seen in FIG. 6B, there is no mechanical interlocking between vertically adjacent boxes. The potential strain of corner weight and/or the lack of mechanical interlocking results in tare weights and/or stacking heights being somewhat limited for bulk boxes 100. Furthermore, the internal positioning of the pedestal platforms 144 is not visible from the outside of the boxes.

Turning to FIGS. 7A, 7B and 7C, a bulk box 200 according to the present invention is shown. The bulk box 200 comprises a base panel 202, two side panels 204, and two side panels 206 which are formed individually and then assembled together. The panels 202, 204 and 206 can be made from a plastic, resin, or other material and formed by an appropriate process, such as rotational molding, blow molding, injection molding, structural foam molding, and/or twin-sheet thermoforming.

It is noteworthy that, even if the bulk box 200 is expected to carry relatively heavy goods, the panels 202, 204, and/or 206 can be made sufficiently strong without structural members (e.g., metal bars or wooden rods) being integrated into the construction of the panels 202, 204 and/or 206. This allows an all-plastic construction of the individual panels, resulting in decreased production costs for these parts (when compared to parts with structural members). That being said, panels incorporating such structural members are certainly possible with and contemplated by, the present invention.

The panels 202, 204, and 206 are assembled together using a slot-and-hook mating arrangement which is, in many ways, similar to that of the bulk box 100. Specifically, the base panel 202 and the side panels 204 have slots 212 and 214, respectively, which mate with corresponding hooks 216 in the side panels 206. The slots 212, the slots 214, and the hooks 216 can have the same geometry as the slots and hooks of the bulk box 100; that is, they may each have a rectangular portion which opens into a wider rectangular capturing portion, whereby each slot has a fat-stem-L shape. Also, the bulk box 200 may be assembled in much the same way as the bulk box 100, with the hooked panels 206 being assembled to the base panel 202 and then the slotted panels 204 being assembled to the hooked panels 206.

Referring now to FIGS. 8A and 8B, the base panel 202 is shown disassembled from the rest of the bulk box 200. The base panel 202 has an overall rectangular shape (in plan) and has through-holes 220 arranged to accommodate molding procedures. The base panel 202 can be square like the base panel 102 of the bulk box 100, but it may be preferable to make one pair of the lateral sides longer than the other pair of lateral sides to take advantage of space within a truck trailer more efficiently. For example, the width of the base panel 202 may be dimensioned so that the combined width of a predetermined number (e.g., two, three, four) of boxes corresponds to the width of the truck's trailer space, with an acceptable tolerance for loading and unloading. Likewise, the length of the base panel 202 may be dimensioned so that the combined length of a predetermined number (e.g., four, five, six, etc) of boxes corresponds to the length of the trailer space, with an acceptable loading/unloading tolerance.

As is best shown in FIG. 8A, the top surface 222 of the illustrated base panel 202 is relatively flat (i.e., no raised stage) with its perimeter rim 226 being flush with the rest of the surface. An elongated groove 228 is positioned adjacent to each of two opposite margins of the rim 226 (corresponding to the location of the slotted side panels 204). The slots 212 are formed within the rim 226 on the remaining two opposite sides (corresponding to the location of the hooked side panels 206).

As best shown in FIG. 8B, the bottom surface 232 of the base panel 202, like the bottom surface 132 of the base panel 102, has dimpled areas 234 and a three-by-three matrix of shortened-cube-shaped pedestals 236. The pedestals 236 define two rows 238 and two columns 240 therebetween. The two rows 238 are recessed (and occupied by the dimpled areas 234) and they can accommodate forklift tines. Unlike the base panel 102 of the bulk box 100, the non-central pedestals 236 are not grooved to form a stacking frame. Instead, the corner pedestals 236 have notches 242 on each lateral side, whereby the ground-contacting platform 244 has a slightly (but not significantly) smaller surface area than the rest of the pedestals 236. Notably, however, the platform 244 extends into the cornermost regions of the corner pedestals 236.

In the illustrated embodiment, the two columns 240 formed between the three rows of pedestals 236 are recessed where they intersect with the two rows 238, but bridges 246 extend between the pedestals 236 in the non-row areas. The bridges 246 have a generally tulip-like cross-sectional shape (forming a trough-like channel therein), with the non-central bridges having a rectangular extension 248 to accommodate the depth of the groove 228. Accordingly, the illustrated bulk box 200 can accept forklift tine approach from only two (rather than the four of the bulk box 100) lateral directions. However, if the base panel 202 is not square for the trailer-space-efficiency reasons discussed above, this two-approach feature has the advantage of insuring that the bulk box 200 is properly oriented when loaded into the truck.

Referring now to FIGS. 9A and 9B, one of the slotted panels 204 is shown disassembled from the rest of the bulk box 200. The panel 204 has a generally rectangular shape with a width corresponding to the width of the base panel 202 and a height corresponding to the desired height of the bulk box 200. More specifically, the panel 204 has a box-interior surface 250, a box-exterior surface 252, lateral flanges 254, a bottom edge 256, and a top edge 258. The lateral flanges 254 each comprise a first leg 254*a* extending parallel with the main body of the panel 204 and a second leg 254*b* extending perpendicularly inward (i.e., towards the inside of the box) from the first leg 254*a* and beyond the box-interior surface 250. Accordingly, the top edge 258 does not have a rectangular shape, but rather has an elongated C-shape with the top edge of the surfaces 250/252 forming the middle C-segment and the top edges of the flanges 254 forming the end C-segments.

The panel 204 includes through-holes 260 and raised ribs 262 arranged for mold-accommodating purposes and/or strength-enhancement on the surfaces 250 and 252. The slots 214 extend through the portion of the panel 204 including the surfaces 250 and 252. More particularly, a pair of slots 214 are positioned adjacent to the proximate edge of each of the lateral flanges 254 for receipt of the hooks 216 of the side panels 206. A shoulder 264 extends downward from the bottom edge 256 for mating with the groove 228 in the base panel 202. Two tabs 266 extend upward from the top edge 258 of the side panel 204 and are positioned to be vertically aligned with the corresponding notches 242 in the base panel 202 in the assembled bulk box 200.

Referring now to FIGS. 10A and 10B, one of the hooked panels 206 is shown disassembled from the rest of the bulk box 200. The panel 206 also has a generally rectangular shape with a width corresponding to the length of the base panel 202 and a height corresponding to the desired height of the bulk box 200. More specifically, the panel 206 has a box-interior surface 270, a box-exterior surface 272, lateral flanges 274, a bottom edge 276, and a top edge 278. The lateral flanges 274 have a generally elbow-like shape with a first leg 274*a* and a second leg 274*b*. The first leg 274*a* extends perpendicularly inward (i.e., towards the inside of the box 200) and beyond the box-interior surface 270. The second leg 274*b* extends perpendicularly outward (i.e., away from the inside of the box 200) from the first leg 274*a*. Accordingly, the top edge 278 does not have a rectangular shape but rather has a roughly flared-C-like shape with the top edge of the surfaces 270/272 forming the middle-C-segment and the flanges 274 forming the flared end-C-segments.

The panel 206 also includes through-holes 280 and ribs 282 arranged for mold-accommodating purposes and/or strength-enhancement reasons on the surfaces 270 and 272. Two hooks 216 extend from the bottom edge 276 of the panel 206 and two hooks 216 extend from the outermost edges of each of the lateral flanges 274. Two tabs 286 extend upward from the top edge 278 and are positioned to be vertically aligned with the corresponding notches 242 in the base panel 202 and are sized/shaped for receipt therein.

Accordingly, as is best seen in FIG. 11A, a top corner portion of the bulk box 200 comprises a "double-thickness" union between the lateral flange 254 of the slotted side panel 204 and the lateral flange 274 of the hooked side panel 206. Specifically, the flanges 254 and 274 interlock with each other in an almost puzzle-like fashion. More specifically, the second leg 254*b* of the lateral flange 254 is positioned between the interior surfaces of the first and second legs of the lateral flange 274 and the second leg 274*b* of the lateral flange 274 is positioned between the exterior surfaces of the first and second legs of the lateral flange 254. Additionally, as is best seen in FIG. 11B, a bottom corner portion of the bulk box 200 comprises a corner pedestal 236 wherein only a small portion is removed by the notches 242 and, significantly, the cornermost portion of the ground-contacting face remains intact.

Referring now to FIG. 12A, a plurality of the bulk boxes 200 are shown stacked one on top of the other. In this stacked arrangement, the non-central pedestals 236 rest upon the upper edges (i.e., the C-shaped top edge 258 and the flared-C-shaped top edge 278) of the side panels 204 and 206. The tabs 266 and 286 in the side panels 204 and 206 are received within the notches 242 in the corner pedestals 236. Thus, the corner weight of the stacked boxes 200 is carried by the "double-thickness" unions between the side panels 204 and 206 and ultimately rests upon the corner pedestals 236 of the lowermost bulk box 200. The "double-thickness" unions and the "increased-surface-area" corner pedestals 236 can translate into an increased stacking strength in the range of 17%. Also, as is best seen in FIG. 12B, the mating of the tabs 266 and 286 with the notches 242 provides a mechanical interlocking between vertically adjacent boxes 200. Moreover, this notch-to-tab mating can be seen from the outside of the bulk boxes 200, thereby providing visual verification of proper box-to-box interlocking.

Accordingly, one may now appreciate that the present invention provides a bulk box 200 that can be initially assembled without tools, is forklift-tine compatible, can be sized to optimize truck trailer space, allows a plurality of boxes to be safely stacked, and/or can be selectively assembled and disassembled. Moreover, the bulk box 200 of the present invention can carry relatively heavy goods even if the panels 202, 204 and 206 have an all-plastic construction without added structural members. Additionally or alternatively, the construction of the bulk box 200 and/or the panels 202, 204, and 206 can be such that it does not sacrifice stacking stability and, in fact, can improve stability while also allowing a visible verification of box-to-box interlocking.

Although the invention has been shown and described with respect to certain preferred embodiments, it is obvious that equivalent and obvious alterations and modifications will occur to others skilled in the art upon the reading and understanding of this specification. The present invention includes all such alterations and modifications.

What is claimed is:

1. A bulk box comprising a base panel and four side panels formed individually and assembled into a container;

wherein the side panels are positioned to provide four corners; and wherein at least some of the side panels include lateral flanges which overlap with a portion of the other side panel forming the corner;

wherein at least some of the side panels are joinable to the base panel by slots and hooks and/or by a groove and shoulder whereby the side panels are disassembleable from the base panel;

wherein the four side panels comprise a first panel and a second panel arranged substantially parallel to each other, and a third panel and a fourth panel arranged substantially parallel to each other and substantially perpendicular to the first and second panels; and wherein:

the first and second panels each have a box-interior surface, a box-exterior surface, a bottom edge, a top edge, and a lateral flange on each lateral edge of the respective panel; and each lateral flange comprises a first leg extending perpendicularly inward and beyond the box-interior surface and a second leg extending perpendicularly outward from the first leg.

2. A bulk box as set forth in claim 1, wherein:

the third and fourth panels each have a box-interior surface, a box-exterior surface, a bottom edge, a top edge, and a lateral flange.

3. A bulk box comprising a base panel and four side panels formed individually and assembled into a container;

wherein the side panels are positioned to provide four corners; and wherein at least some of the side panels include lateral flanges which overlap with a portion of the other side panel forming the corner;

wherein at least some of the side panels are joinable to the base panel by slots and hooks and/or by a groove and shoulder whereby the side panels are disassembleable from the base panel;

wherein the four side panels comprise a first panel and a second panel arranged substantially parallel to each other, and a third panel and a fourth panel arranged substantially parallel to each other and substantially perpendicular to the first and second panels; wherein:

the third and fourth panels each have a box-interior surface, a box-exterior surface, a bottom edge, a top edge, and a lateral flange on each lateral edge of the respective panel;

each lateral flange comprises a first leg extending perpendicularly inward and beyond the box-interior surface and a second leg extending perpendicularly outward from the first leg.

4. A bulk box comprising a base panel and four side panels formed individually and assembled into a container;

wherein the side panels are positioned to provide four corners;

wherein at least some of the side panels include lateral flanges which overlap with a portion of the other side panel forming the corner;

wherein the four side panels comprise a first panel and a second panel arranged substantially parallel to each other, and a third panel and a fourth panel arranged substantially parallel to each other and substantially perpendicular to the first and second panels;

wherein the third and fourth panels each have a box-interior surface, a box-exterior surface, a bottom edge, a top edge, and a lateral flange on each lateral edge of the respective panel;

wherein each lateral flange comprises a first leg extending perpendicularly inward and beyond the box-interior surface and a second leg extending perpendicularly outward from the first leg; and wherein the first and second panels each have a shoulder extending downward from the bottom edge for mating with a groove in the base panel.

5. A bulk box as set forth in claim 3, wherein the first and second panels each have slots, and the third and fourth panels have hooks which mate with the slots in the first and second panels to join the four panels together.

6. A bulk box as set forth in claim 1, wherein the side panels each have a top edge, wherein at least some of the side panels have tabs extending upward from the top edge, and wherein the base panel has notches aligned with the tabs and sized to receive such tabs.

7. A bulk box as set forth in claim 1, wherein the base panel comprises a matrix of pedestals having lower ground-contacting platforms, wherein the matrix of pedestals includes corner pedestals and wherein the ground-contacting platforms of each of the corner pedestals extend to the cornermost region of the respective corner pedestal.

8. A bulk box as set forth in claim 7, wherein the matrix of pedestals includes four corner pedestals.

9. A bulk box as set forth in claim 7, wherein the matrix of pedestals defines at least two recessed rows sized and shaped to accommodate forklift tines.

10. A bulk box comprising a base panel and four side panels formed individually and assembled into a container;

wherein the side panels are positioned to provide four corners;

wherein at least some of the side panels include lateral flanges which overlap with a portion of the other side panel forming the corner;

wherein each lateral flange comprises a first leg extending perpendicularly inward and beyond a box-interior surface and a second leg extending perpendicularly outward from the first leg;

wherein at least some of the side panels are joinable to the base panel by slots and hooks and/or by a groove and shoulder whereby the side panels are disassembleable from the base panel; and wherein the base panel has an all-plastic construction without structural members of another material.

11. A bulk box as set forth in claim 1, wherein at least one of the side panels has an all-plastic construction without structural members of another material.

12. A bulk box as set forth in claim 1, wherein the four side panels each have an all-plastic construction without structural members of another material.

13. A bulk box comprising a base panel and four side panels formed individually and assembled into a container;

wherein the side panels are positioned to provide four corners;

wherein at least some of the side panels include lateral flanges which overlap with a portion of the other side panel forming the corner;

wherein each lateral flange comprises a first leg extending perpendicularly inward and beyond a box-interior surface and a second leg extending perpendicularly outward from the first leg;

wherein at least some of the side panels are joinable to the base panel by slots and hooks and/or by a groove and shoulder whereby the side panels are disassembleable from the base panel; and wherein the base panel and the four side panels each have an all-plastic construction without structural members of another material.

14. The bulk box of claim 1, with the panels being disassembled from each other.

15. A plurality of the bulk boxes of claim 1 stacked one on top of the other.

16. A plurality of the bulk boxes of claim 6 stacked one on top of the other, wherein the tabs of a lower bulk box are received within the notches of an upper bulk box.

17. A plurality of bulk boxes as set forth in claim 16, wherein receipt of the tabs within the notches can be seen from the outside of the stacked boxes, thereby providing visual verification of interlocking between the boxes.

18. A method of transporting goods from a first location to a second location, said method comprising the steps of:

filling the bulk box of claim 1 with goods at the first location;

transporting the filled bulk box to the second location;

emptying the goods from the bulk box at the second location; and transporting the bulk box back to the first location or to another location.

19. A method as set forth in claim 18, further comprising the step of filling the bulk box with other goods after said emptying step but prior to the second transporting step.

20. A method as set forth in claim 18, further comprising the step of disassembling the panels of the bulk box prior to the second transporting step.

21. A method as set forth in claim 20, further comprising the step of re-assembling the panels of the bulk box after the second transporting step and then repeating the filling, transporting, and emptying steps.

22. A method of making the bulk box of claim 1, said method comprising the steps of:

individually forming the base panel and the side panels; and assembling the panels together into the container.

23. A bulk box comprising a base panel and four side panels individually formed and assembled/assemble-able into a container;

wherein the base panel comprises a matrix of pedestals having lower ground-contacting platforms, wherein the matrix of pedestals includes corner pedestals and wherein the ground-contacting platform of each of the corner pedestals extends to the cornermost portions of the respective corner pedestal;

wherein the four side panels are positioned to provide four corners aligned with the corner pedestals;

wherein each of the four corners comprises a pair of flanges interlocking to form a double-thickness union between the adjacent side panels;

wherein each lateral flange comprises a first leg extending perpendicularly inward and beyond a box-interior surface and a second leg extending perpendicularly outward from the first leg;

wherein the flanges are formed in one piece with the side panels; and wherein the four side panels are joined together with slots and hooks.

24. A bulk box as set forth in claim 23, wherein the matrix of pedestals includes four corner pedestals.

25. A bulk box as set forth in claim 24, wherein the matrix of pedestals is an at least three-by-three matrix.

26. A bulk box as set forth in claim 24, wherein the matrix of pedestals defines at least two recessed rows sized and positioned to accommodate forklift tines.

27. A bulk box as set forth in claim 23, wherein at least some of the corner pedestals include notches, and wherein at least some of the side panels include upper tabs vertically aligned with the notches and sized for receipt therein.

28. A plurality of the bulk boxes of claim 27 stacked one on top of the other, wherein the tabs of a lower bulk box are received within the notches of an upper bulk box.

29. A plurality of bulk boxes stacked one on top of the other, each bulk box comprising a base panel and four side panels individually formed and assembled/assemble-able into a container, wherein the base panel comprises a matrix of pedestals having lower ground-contacting platforms, wherein the matrix of pedestals includes corner pedestals and wherein the ground-contacting platform of each of the corner pedestals extends to the cornermost portions of the respective corner pedestal, wherein the four side panels are positioned to provide four corners aligned with the corner pedestals, wherein each of the four corners comprises a pair of flanges interlocking to form a double-thickness union between the adjacent side panels, wherein the flanges are formed in one piece with the side panels, and wherein at least some of the corner pedestals include notches, and wherein at least some of the side panels include upper tabs vertically aligned with the notches and sized for receipt therein wherein the tabs of a lower bulk box are received within the notches of an upper bulk box; and wherein receipt of the tabs within the notches can be seen from outside of the stacked boxes, thereby providing visual verification of box-to-box interlocking.

30. A bulk box comprising a base panel and four side panels formed individually and assembled into a container;

wherein the side panels are positioned to provide four corners;

wherein the side panels each have a main body with a box-interior surface and a box-exterior surface;

wherein the side panels include lateral flanges with the lateral flange of one of the side panels overlapping with the lateral flange of another of the side panels forming the corner therewith;

wherein the lateral flanges are formed in one piece with the main body of the respective side panel;

wherein each lateral flange comprises a first leg extending perpendicularly inward and beyond a box-interior surface and a second leg extending perpendicularly outward from the first leg;

wherein the base panel comprises a matrix of pedestals having lower ground-contacting platforms, wherein the matrix of pedestals includes corner pedestals and wherein the ground-contacting platforms of each of the corner pedestals extend to the cornermost region of the respective corner pedestal; and wherein the four side panels are joined together with slots and hooks.

31. A bulk box as set forth in claim 30, wherein the matrix of pedestals includes four corner pedestals.

32. A bulk box as set forth in claim 31, wherein the matrix of pedestals defines at least two recessed rows sized and shaped to accommodate forklift tines.

33. A plurality of the bulk boxes stacked one on top of the other, each bulk box comprising a base panel and four side panels formed individually and assemble-able into a container and wherein in each bulk box:

the side panels are positioned to provide four corners;

the side panels each have a main body with a box-interior surface and a box-exterior surface;

the side panels include lateral flanges with the lateral flange of one of the side panels overlapping with the lateral flange of another of the side panels forming the corner therewith;

the lateral flanges are formed in one piece with the main body of the respective side panel;

wherein each lateral flange comprises a first leg extending perpendicularly inward and beyond a box-interior surface and a second leg extending perpendicularly outward from the first leg;

wherein at least some of the side panels have tabs extending upward from a top edge, wherein the base panel has notches aligned with the tabs, and wherein the tabs of a lower bulk box are received within the notches of an upper bulk box; and wherein receipt of the tabs within the notches can be seen from outside of the stacked boxes, thereby providing visual verification of box-to-box interlocking.

* * * * *